United States Patent [19]

Marshall

[11] Patent Number: 4,743,015

[45] Date of Patent: May 10, 1988

[54] EXERCISE DEVICE SIMULATING CROSS COUNTRY SKIING

[75] Inventor: Frank E Marshall, Portland, Oreg.

[73] Assignee: The Fitness Agency, Portland, Oreg.

[21] Appl. No.: 890,098

[22] Filed: Jul. 28, 1986

[51] Int. Cl.[4] ..... A63B 69/18; A63B 21/00

[52] U.S. Cl. ..... 272/97; 272/70; 272/133

[58] Field of Search ..... 272/70, 72, 97, 132, 272/133, 73, 69, 126, DIG. 4, 135

[56] References Cited

U.S. PATENT DOCUMENTS

| | | | |
|---|---|---|---|
| 2,614,609 | 10/1952 | Denison | 272/70 |
| 4,023,795 | 5/1977 | Pauls | 272/97 |
| 4,421,307 | 12/1983 | Cunnington et al. | 272/72 |
| 4,477,071 | 10/1984 | Brown et al. | 272/72 |
| 4,540,172 | 9/1985 | Evans | 272/133 |
| 4,618,139 | 10/1986 | Haaheim | 272/126 |
| 4,645,201 | 2/1987 | Evans | 272/70 |

*Primary Examiner*—Richard J. Apley
*Assistant Examiner*—S. R. Crow
*Attorney, Agent, or Firm*—Robert L. Harrington

[57] ABSTRACT

An exercise devise that simulates cross country skiing. A pair of rails are mounted between pivotable handles simulating ski poles. Foot pads slidably mounted on the rails are interconnected by a loop including a flexible strap that extends along each rail and around curved static bearing surfaces at each end. A spring maintains the strap of the loop tightly against the static bearing surfaces to generate resistance to sliding movement of the foot pads. The tension in the spring is adjustable by a tightener that shortens the length of the loop and thereby tightens the strap against the static bearing surfaces.

8 Claims, 2 Drawing Sheets

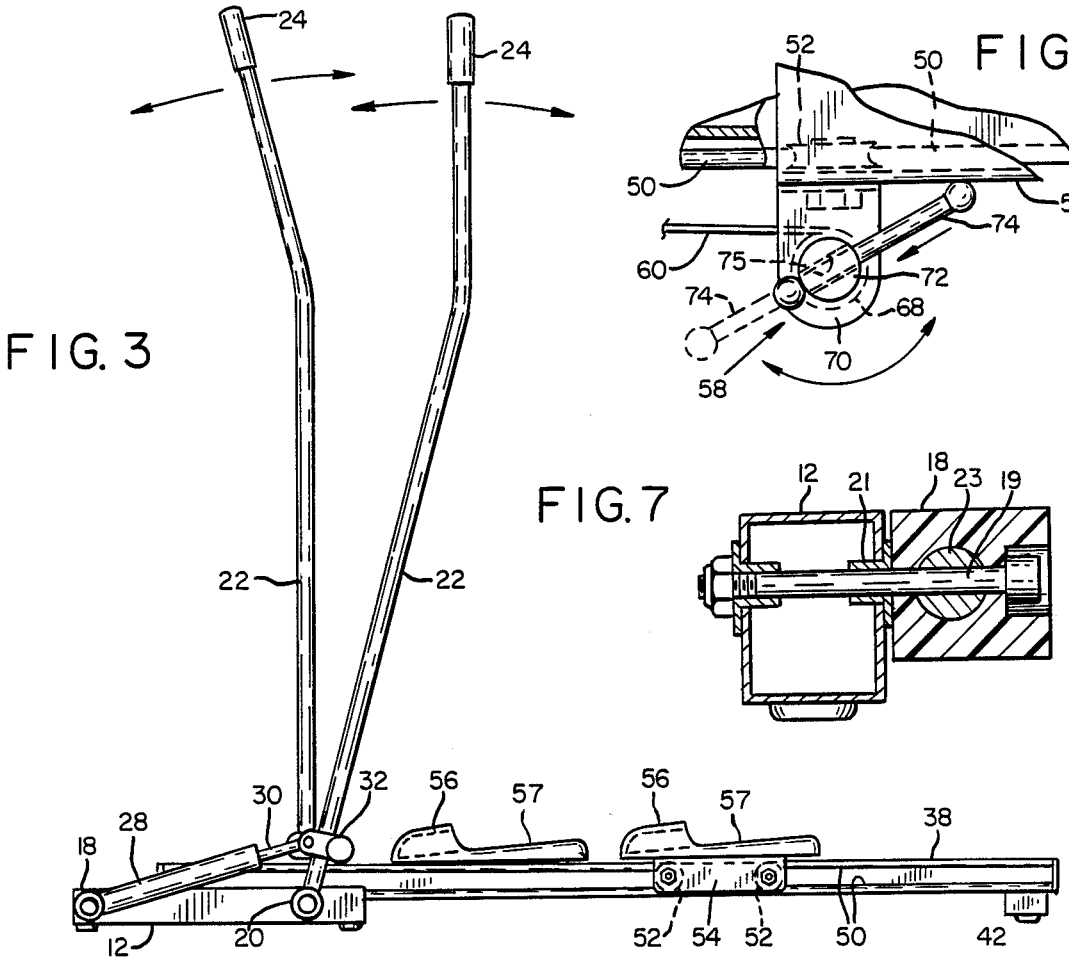
FIG. 3
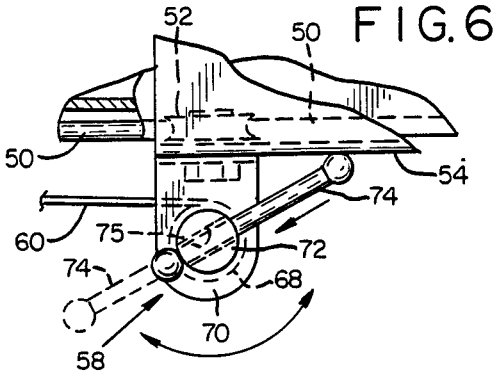
FIG. 6
FIG. 7
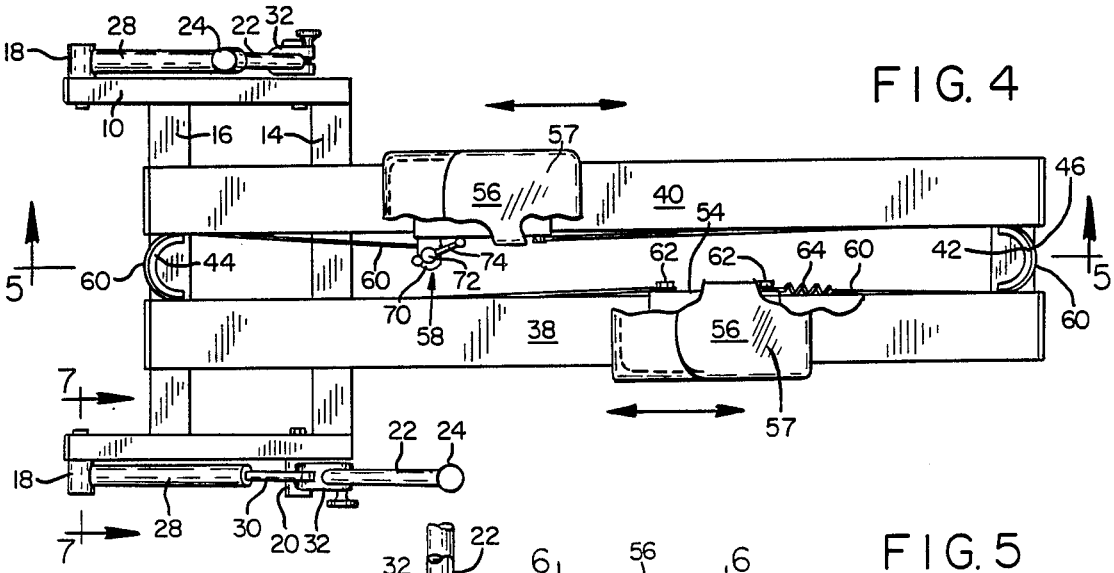
FIG. 4
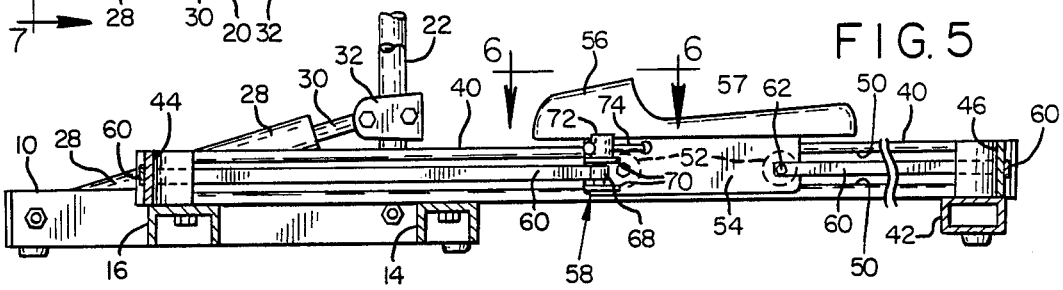
FIG. 5

EXERCISE DEVICE SIMULATING CROSS COUNTRY SKIING

FIELD OF INVENTION

This invention relates to an exercise device that simulates cross country skiing, and more particularly provides such a device in a simplified, efficient and cost saving design.

BACKGROUND OF THE INVENTION

Cross country skiing has become accepted as a preferred form of exercise. However, it is not readily available and certainly not on a regular basis, to a large percent of the population having an interest in this form of exercise. Applicant's device for home use is intended to simulate this popular form of exercise and recreation.

In cross country skiing, the skier attaches skis to his feet which are propelled along the snow covered ground in a shuffling motion. One of the skiers feet are moved forward and planted as the other foot is drawn rearward. The action is then reversed and so on.

To assist the user (and also for balancing) the skier uses ski poles that are spiked into the ground first on one side and then the other side of the skier as the skier progresses forwardly.

It will be appreciated that the forces that come into play in resisting cross country skiing movement can vary from person to person i.e. by the use of more or less pulling power on the poles and inversely, more or less leg power on the skis. A device simulating cross country skiing for home use, should be adjustable to adapt the device to the user's perference of leg power versus arm power, and it should be capable of simulating the motion of rapid forward movement while remaining stationary, i.e., it should give the impression of movement.

The effect of ski pole movemetn is duplicated quite satisfactorily by providing a pivoted pole that adjustably resists (but does not prevent) pivoting in one direction. The resistance is provided by hydraulic cylinders. With a pole at each side, the user alternately pushes the poles forward with little effort (similar to moving a pole forward and spiking it at a forward position during actual cross country skiing) and then with effort (against the hydraulic pressure) pulls the pole back to the start up position.

The primary objective of the present invention is to provide the mechanism that simulates the shuffling feet.

SUMMARY OF THE INVENTION

In the preferred embodiment of the invention, two spaced parallel rails are mounted between simulated poles as described above. A foot pad is slidably mounted on each rail for relatively effortless movement of the pads along the rails. The rails are joined at each end by a semi-circular curved member, the convex side of the curve of each member facing outwardly and thereby providing a stationary or static bearing surface. (Said members are hereafter sometimes referred to as static bearing members.)

A flexible strap extends along one rail from the foot pad thereon toward the forward end, and around the bearing member at that end. The strap extends back along the other rail to the other foot pad thereon. The foot pads are each anchored to the strap and the strap continues to the opposite end of the rails, around that bearing member and back to the first foot pad.

It will be appreciated that as one foot pad is moved rearward on its rail, by reason of the interconnecting strap, the other foot pad is forced forward on its rail. Resistance to this movement is provided by the friction created as the strap is pulled around the curved surfaces of the static bearing members. A tensioning member e.g. a spring, maintains a taut engagement of the strap against the static bearing member. The tension is increased by tighetning the strap against this tensioning force and thereby increasing the frictional resistance.

The above features provided for the invention will be more clearly understood and appreciated by reference to the following detailed description, having reference to the accompanying drawings wherein;

FIG. 3 is a side view of the device of FIG. 1;

FIG. 4 is a top view of the device of FIG. 1;

FIG. 5 is a sectional view as taken on view lines 5—5 of FIG. 4;

FIG. 6 is a view of the strap tightening feature of the device as taken on view lines 6—6 of FIG. 5;

FIG. 7 is a sectional view of the ski pole pivot as taken on view lines 7—7 of FIG. 4.

Figure 1:
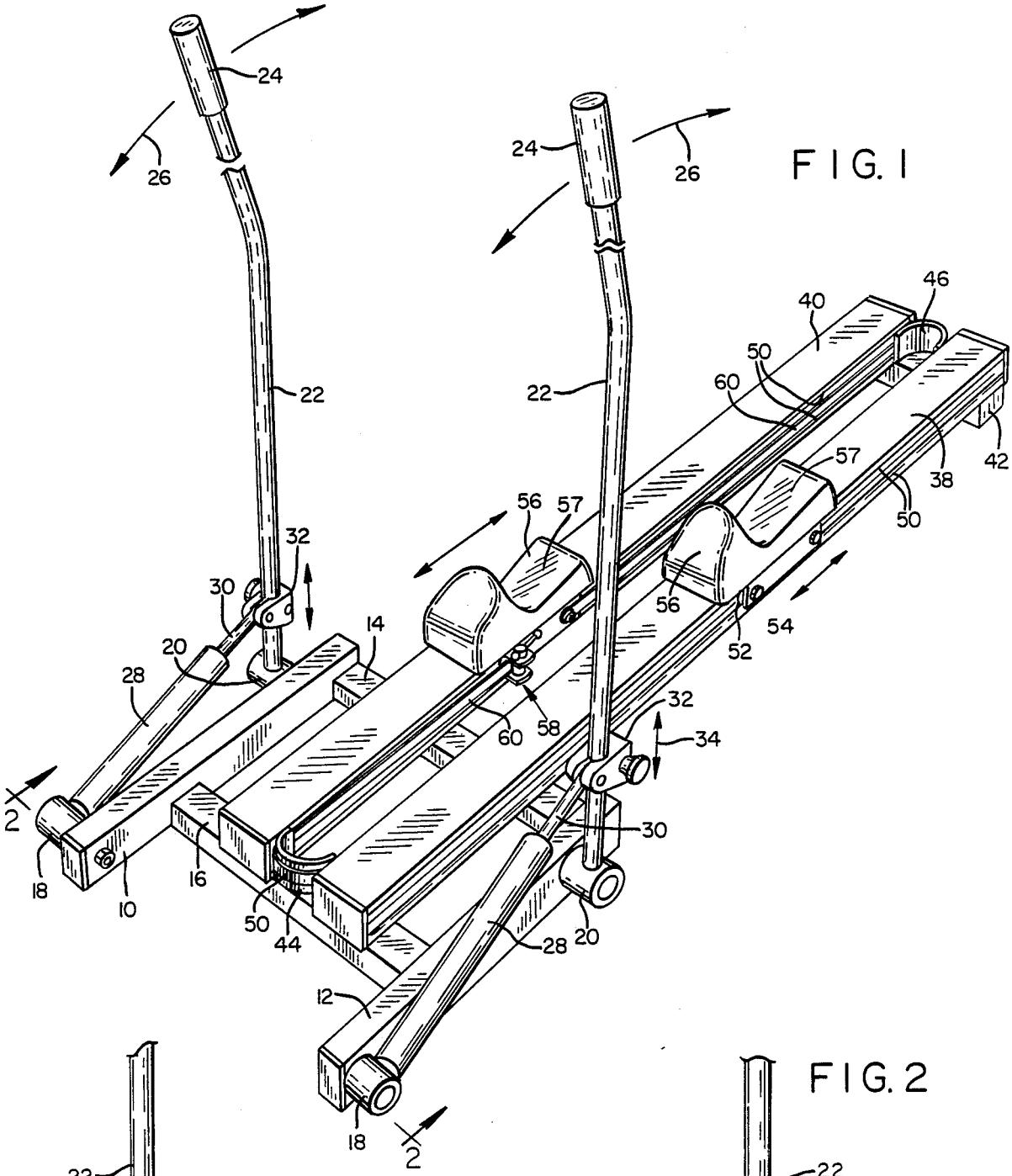
FIG. 1 is a perspective view of an exercise device in accordance with the present invention.

Reference is made to FIG. 1 wherein a base structure is illustrated as having a pair of parallel extended elongated support members 10 and 12 fixed together by cross braces 14 and 16. Whereas the components of the base structure can take many forms, the illustrated support members and cross bars are constructed of rectangular tubular aluminum.

A pair of left and right simulated ski poles are mounted to the outside of the support members 10 and 12. Each simulated ski pole includes a front horizontal pivot 18 and a rear horizontal pivot 20. Refer to FIG. 7 wherein the pivot 18 is illustrated as a cylinder pivotally attached by bolt 19 to support 12 having bearing 21 interposed therebetween. A stub shaft 23 from the cylinder base (cylinder 28 to be described hereafter) is attached to the pivot 18. A ski pole handle 22 is attached to the rear pivot 20 and extends upwardly therefrom, terminating in a handle grip 24. The horizontal pivot permits pivoting of the ski pole handle in a forward arc as indicated by arrows 26.

A hydraulic cylinder 28 is attached at its base end to front pivot 18, and the rod 30 thereof is attached through a bracket 32 to the handle 22. The bracket is adapted for adjustment up and down on the ski pole handle (indicated by arrow 34) with lock means 36 being manually releasably lockable to the handle 22. This adjustment to the bracket 32 up and down on the handle provides adjustment of the resistive force. It will be appreciated that, in a conventional manner, the hydraulic cylinder is designed to resist pulling i.e. rearward movement, while allowing relatively free pushing i.e. forward movement of the ski pole handles. Raising the bracket 32 on the ski pole handle increases the resistance to the pulling motion.

Fastened to the cross bars 14 and 16, are the front ends of left and right parallel rails 38 and 40 respectively. The rear ends of the rails are supported at a similar elevation by cross bar 42. Mounted between the rails at the ends thereof are front and rear bearing members 44 and 46 respectively. The bearing members 44, 46 are arcuately shaped with the convex side facing outwardly.

Figure 2:
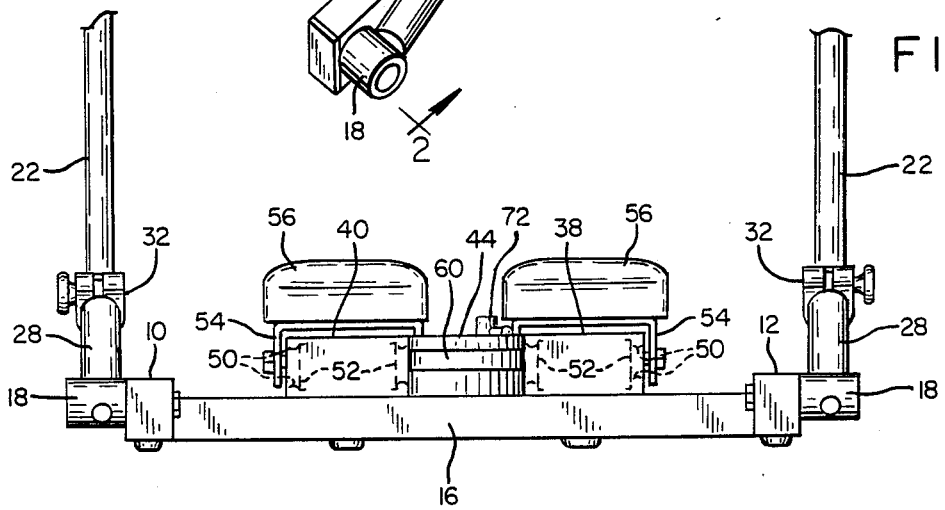
FIG. 2 is a front view of the device of FIG. 1 as taken on view lines 2—2 thereof.

Guideways 48 are provided lengthwise along both inner and outer sides of the left and right rails. Each guideway is formed with a lower guide rib 50 (see FIG. 2).

An inverted U shaped bracket 54 straddles each rail and depending legs of the bracket at each side carry inwardly extended rollers 52 that are entrained on the guide ribs 50. A foot pad 56 is mounted to the top of each bracket 54 for the left and right feet of the user.

As seen in FIG. 4 particularly (but also see FIGS. 1, 2 and 5), a flexible, tough, non-stretchable strap 60 (e.g. of nylon webbed material) is attached to the inner depending leg of the bracket 54 under the right foot pad 56 (through a tightener 58 to be explained later). The first section of the strap 60 extends forwardly from the right foot pad bracket 54 along the groove formed by the guideway 48 in the right rail 40, around the front bearing member 44 (bearing against the outer convex side thereof) and back along the inner guideway of the left rail 38 to the bracket under the footpad (attached to the inner depending leg of the bracket by fastener 62).

Attached to the left foot pad bracket and extended rearwardly therefrom is a spring 64 that in turn is attached to a second section of strap 60. This second section of strap 60 extends rearwardly in guideway 48, around the rear bearing member 46, forwardly down the right rail inner guideway to the right footpad bracket where it is anchored by fastener 66.

The two foot pads are thus tied together by the strap section 60 and spring 64. The foot pads are otherwise free to move forward and backward along the rail, but in directions opposite to one another. Resistance to the movement is provided by the frictional engagement of the strap sections bearing against the convex surface of the bearing members 44 and 46. The spring 64 maintains a continuous urging of this frictional contact and this contact can be increased or decreased by the tightener 58 which will now be explained.

The tightener is specifically shown in FIG. 6 but also refer to FIGS. 1 and 4. The fastener 58 includes a spool 68 rotatably mounted in a bracket 70 carried by the right foot pad bracket 54. The core 72 of the spool 68 protrudes upwardly through the bracket 70. A lever 74 is slidable through a hole 75 in the core and provides the leverage for manually turning spool 68. The relationship of the length of the lever 74 and the distance of the spool 68 from the depending leg of bracket 54 prevents turning of the spool without intermittent sliding of the lever 74 back and forth through the core hole 75. (See the dash lines in FIG. 6 which illustrates the shifted position of lever 74 that is necessary in order to rotate the spool counter clockwise from the position shown in solid lines).

Turning of spool 68 can be effected clockwise while counter clockwise rotation is prevented by the extended end of the lever 74. The position of the lever thus locks the spool against unwinding (in that strap 60 is wound clockwise on the spool and unwinding thereof requires counter clockwise rotation). Tightening of the strap 60, to increase tension of spring 64 and thereby increase friction of the strap against the bearing surfaces, is accomplished by manually turning lever 74 clockwise e.g. a half turn or 90 degrees. The lever is then slid back through the hole 75 so that it now again extends forwardly of the spool and engages the bracket 54 of the right foot pad 56 to prevent unwinding.

Operation

In using the apparatus described herein, the user slides his feet into the respective foot pads 56 and grabs the left and right hand grips 24. Considering the starting position shown in the drawings i.e. with the right foot forward, the user allows his left foot to be drawn forward while forcing the right foot backwards. The right leg thus produces the power necessary to overcome the resistance of the strap 60 being dragged around the bearing surface of bearing members 44, 46. The slight rearward angle of the foot supporting surfaces in foot pads 56 (surface 57 shown in dash lines in FIG. 3) assists the user in the application of the rearward forcing movement of the foot pads. This angle is preferably produced by raising the heel and of the surface 57 about ½ inch over a 10 inch span of the support surface.

At the same time, the right arm pulls rearward on the handle 22 while pushing the left handle forward. The right handle movement is resisted by the hydraulic cylinder 28 while little effort is encountered in the movement of the left handle. The movements of both the foot pads and the handles are then reversed in a repeating cycle, closely simulating the shuffling motion of a cross country skier.

Also, should the user desire to increase or decrease the resistance against the handle movements or the foot movements, such is achieved simply by raising or lowering brackets 32 on handles 22 and loosening or tightening the strap 60 around spool 68 of tightener 58.

Whereas there are a number of novel features incorporated in the illustrated embodiment of the invention, the basic concept of tying the foot pads together with a strap extended around the ends of the static bearing surfaces to obtain resistance and the adjustment thereof is believed novel. Note for example that the combination of the static bearing surfaces generates a 360 degree surface of resistance to the strap movement. Those familiar with the art will likely, upon review of this disclosure, develop numerous variations and modifications but without departing from the inventive concept as defined and encompassed in the claims appended hereto.

I claim:

1. An exercise apparatus simulating cross country skiing comprising: a pair of rails mounted in spaced parallel relationship, a foot pad for each rail that is mounted to the rail for sliding movement along the top of the rail and designed to accommodate the left and right feet of a user, a pair of static bearing members each extended between the two rails at forward and rearward spaced position, each of said static bearing members having outwardly facing convex bearing surfaces, and a flexible interconnecting loop including strap sections and connected at one end to one of the foot pads, extending around one bearing surface and connected to the other of the foot pads, then around the other bearing surface and back to the first foot pad whereby a forward sliding movement of one foot pad causes rearward sliding of the other foot pad and vise versa, said strap sections being drawn over the bearing surfaces for frictional resistance of the foot pad sliding movement, and loop tightening means including a spring member forming a part of the loop and urging spring biased tightening of the strap against the convex bearing surfaces, said spring member increasing in tension with stretching thereof, and tension adjustment means exposed outside the foot pads for intermittent adjustment during use by the user including a strap tightener for shortening the effective length of said strap and thereby stretching of said spring member to enable a user to selectively increase the spring tension and and being the sole tensioning adjustment means to increase the frictional engagement of said strap sections against the convex bearing surfaces.

2. An exercise apparatus as defined in claim 1 wherein simulated ski pole handles are attached adjacent the rails, one way resistance means are coupled to the handles to resist movement thereof in the rearward direction only.

3. An exercise apparatus as defined in claim 1 wherein the remainder of the interconnecting loop other than the spring member is non-stretchable.

4. An exercise apparatus as defined in claim 3 wherein said spring tensioning means includes a strap section attached to a foot pad through a tightener mechanism, said tightener mechanism including a rotatable spool on which a strap end is wound whereby rotation of the spool in one direction shortens the said remainder of the loop while stretching the spring member to thereby increase the frictional resistance to the loop being drawn around the bearing surfaces, and lock means to lock the spool against unwinding.

5. An exercise apparatus as defined in claim 4 wherein the lock means includes a lever slidably mounted crossways through the spool axis, said spool being mounted closely adjacent to the foot pad, and said lever extending further than the distance between the foot pad and spool whereby rotation of the spool is prevented without sliding the lever through the spool away from the foot pad.

6. An exercise devise as defined in claim 4 wherein an inverted U shaped bracket forms a part of the foot pads, said inverted U shaped brackets having depending legs that straddle the rail with the intermediate portion of the bracket supporting the foot pads, guideways along each side of the rails, bearing rollers carried by the depending legs of the foot pad bracket and extended into the guideways for sliding support of the foot pads along the guideways.

7. An exercise devise as defined in claim 6 wherein a guide rib is formed in conjunction with the guideway for entraining the rollers of the foot pad brackets.

8. An exercise device as defined in claim 1 wherein the foot pads are provided with foot supporting surfaces, said foot supporting surfaces being angled rearwardly and upwardly to assist the pushing action of the foot in forcing the foot pad rearwardly.

* * * * *